US005979277A

United States Patent [19]

Kitsuda et al.

[11] Patent Number: 5,979,277

[45] **Date of Patent: *Nov. 9, 1999**

[54] METHOD AND APPARATUS FOR PUNCHING A THIN METAL TAPE TO PROVIDE A LEAD FRAME FOR A SEMICONDUCTOR DEVICE

[75] Inventors: Takehiro Kitsuda; Hiroshi Fujikawa; Keiichi Sato, all of Tokyo; Makoto Someno, Saitama, all of Japan

[73] Assignee: Hitachi Cable, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/595,522

[22] Filed: Feb. 1, 1996

Related U.S. Application Data

[63] Continuation of application No. 08/100,736, Jul. 30, 1993, abandoned.

[30] Foreign Application Priority Data

| | | | |
|---|---|---|---|
| Jul. 31, 1992 | [JP] | Japan | 4-059692 |
| Nov. 11, 1992 | [JP] | Japan | 4-326066 |
| Jan. 20, 1993 | [JP] | Japan | 5-024778 |

[51] Int. Cl.[6] ..... B21D 28/02; B26D 1/00; B26D 7/06

[52] U.S. Cl. ..... 83/13; 83/133; 83/140; 83/143; 83/620; 83/176; 83/929.2; 83/19; 72/334; 72/327

[58] Field of Search ..... 83/133, 140, 143, 83/13, 620, 929.1, 929.2, 670, 19, 176, 451; 72/334, 327, 328, 333, 379.2

[56] References Cited

U.S. PATENT DOCUMENTS

| | | | |
|---|---|---|---|
| 1,849,669 | 3/1932 | Glasner et al. | 72/334 |
| 3,878,746 | 4/1975 | Carmeli | 83/126 |
| 4,569,263 | 2/1986 | Kravets | 83/19 |
| 4,711,115 | 12/1987 | Sukonnik et al. | 72/334 |
| 4,893,394 | 1/1990 | Muller | 29/243.519 |
| 5,054,188 | 10/1991 | Sabado | 29/564.6 |
| 5,074,139 | 12/1991 | Elliott | 72/129 |
| 5,105,857 | 4/1992 | Ellis | 140/105 |
| 5,295,390 | 3/1994 | Hosono | 72/334 |

*Primary Examiner*—Rinaldi I. Rada
*Assistant Examiner*—Boyer Ashley
*Attorney, Agent, or Firm*—Helfgott & Karas, P.C.

[57] ABSTRACT

A stripper holder for holding a stripper plate conforms with the deformation of a die plate. A pressing force applied to the stripper plate and is greater than an elastic limit of a metal tape to be punched, and less than a pressing deformation or breakage force of the metal tape. The stripper holder may also be flexible, or such that the metal tape is pressed at two different positions for one punching position by two different pressing forces.

2 Claims, 9 Drawing Sheets

METHOD AND APPARATUS FOR PUNCHING A THIN METAL TAPE TO PROVIDE A LEAD FRAME FOR A SEMICONDUCTOR DEVICE

This is a continuation of application Ser. No. 08/100,736, filed Jul. 30, 1993 now abandoned.

FIELD OF THE INVENTION

The invention relates to a method and an apparatus for punching a metal tape to be a patterned member, and more particularly to a method and an apparatus for punching a thin metal tape to provide a lead frame used for a semiconductor device.

BACKGROUND OF THE INVENTION

A conventional apparatus for punching a metal tape to be a patterned member comprises a die plate for placing a metal tape thereon, a stripper plate for pressing the metal tape on the die plate, punches for punching the metal tape pressed on the die plate by the stripper plate, wherein the punches are held by an upper base moving down and up in operation, and the stripper plate is provided with punch slots and fixed to a stripper holder which is pulled up and resiliently moved down by the upper base, while the die plate is provided with punch slots for allowing the punches to move down and is positioned on a backing plate provided on a lower base.

In operation, a metal tape is placed on the die plate, and the upper base is moved down by receiving an appropriate driving force. In accordance with the moving-down of the upper base, the punches and the stripper holder are moved down, and when the stripper plate becomes contacted with the metal tape placed on the die plate, the stripper holder is stopped, and the upper base moves down by a limited distance determined by a compression amount of a coil spring within a designed gap provided between the upper base and the stripper holder. In accordance with the moving-down of the upper base, the punches protrude through the punch slots of the stripper plate from the stripper holder to punch the metal tape and are inserted into the punch slots of the die plate. Thus, the metal tape is punched with a pattern based on the arrangement of the punches.

Then, the punches, and then the stripper holder are pulled up in accordance with the moving-up of the upper base. At this stage, the stripper plate serves as stripping the punched metal tape off the moving-up punches.

The metal tape is, for instance, as thin as 0.15 mm to provide a lead frame having inner and outer leads used for a semiconductor device, in which the inner leads are connected to electrodes of a semiconductor chip.

In the conventional punching apparatus, however, there is a disadvantage in that deflection and torsion of a patterned member obtained by punching the metal tape occurs especially at tip portions of the pattern, because internal distortion remained in the metal tape represents at the punching time, and processing distortion is additionally generated on the metal tape at the same time. As a result, the patterned member such as a lead frame is deteriorated in precision.

One of reasons why the deflection and the torsion occur is that the die plate is deformed independently of the stripper holder and plate at the punching time, so that the conformity between the stripper plate and the die plate is not sufficiently obtained.

SUMMARY OF THE INVENTION

Accordingly, it is an object of the invention to provide a method and an apparatus for punching a metal tape to be a patterned member in which a patterned member having less deflection and torsion is obtained.

It is a further object of the invention to provide a method and an apparatus for punching a metal tape to be a patterned member in which distortion remained in the metal tape does not cast any influence on the patterned member.

It is a still further object to provide a method and an apparatus for punching a metal tape to be a patterned member in which punching operation is carried out without generating distortion on the patterned member.

According to the first feature of the invention, a method for punching a metal tape to be a patterned member, comprises the steps of:

- placing the metal tape on a die plate;
- pressing the metal tape placed on the die plate by a pressing force, the pressing force being greater than an elastic limit of the metal tape and less than a breakage force thereof;
- punching the metal tape pressed on the die plate, the metal plate being the patterned member.

According to the second feature of the inventions, an apparatus for punching a metal tape to be a patterned member, comprises:

- a stripper holder for holding a stripper plate having punch slots corresponding to punching states;
- punches for punching the metal tape by protruding through the punch slots of the stripper plate;
- means for moving the stripper holder and the punches down and up;
- a die plate for placing the metal tape thereon, the die plate having punch slots at positions corresponding to the punch slots of the stripper plate; and
- means for applying a pressing force via the stripper plate to the metal tape, the pressing force being greater than an elastic limit of the metal tape and less than a pressing breakage force;
- wherein the metal tape is punched by the punches, under a situation where the metal tape is pressed on the die plate by the stripper plate.

BRIEF DESCRIPTION OF THE DRAWINGS

The invention will be explained in more detail in conjunction with the appended drawing, wherein.

DESCRIPTION OF THE PREFERRED EMBODIMENT

Before explaining an apparatus for punching a metal tape to be a patterned member in the first preferred embodiment according to the invention, the aforementioned conventional punching apparatus will be explained.

Figure 1:
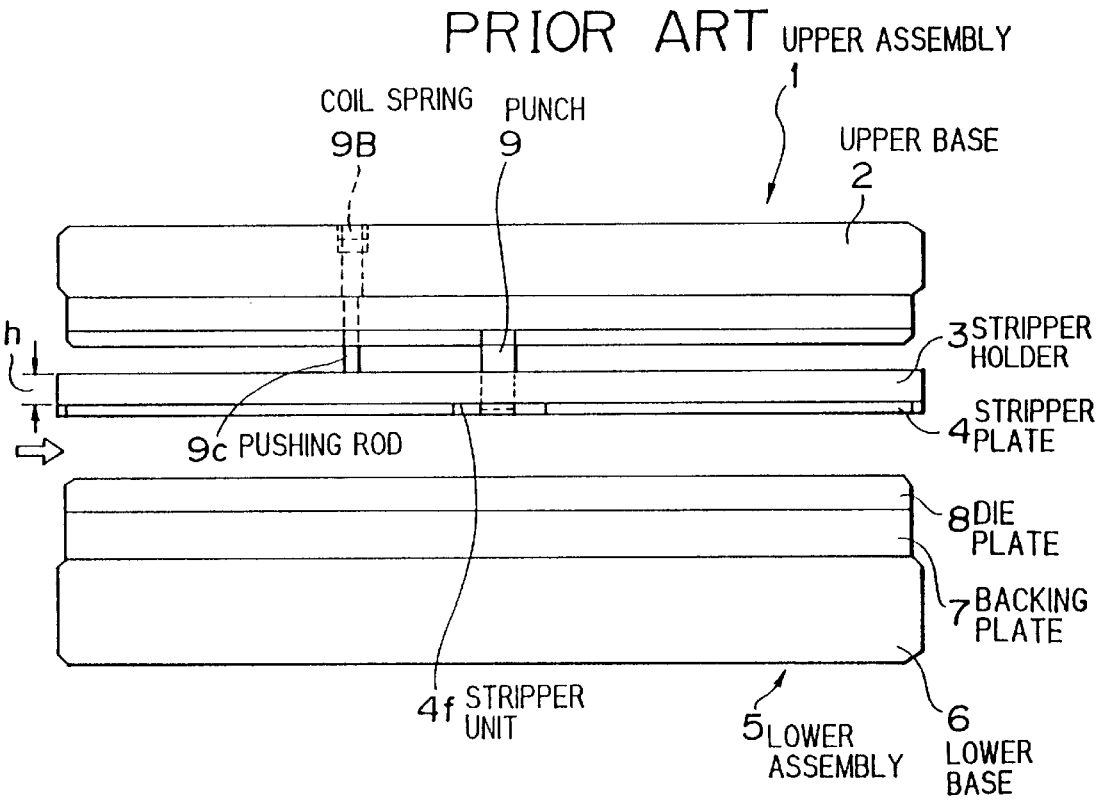
FIG. 1 PRIOR ART
FIG. 1 is a front view showing a conventional apparatus for punching a metal tape to be a patterned member.

FIG. 1 shows the conventional punching apparatus which comprises an upper assembly 1 and a lower assembly 5. The upper assembly 1 comprises an upper base 2 which is moved down and up by a drive source (not shown), a stripper holder 3 connected via coil springs 9B (only one shown) to the upper base 2 by pushing rods 9C (only one shown); a stripper plate 4 held by the stripper holder 3, and punches 9A (only one shown) for punching a metal tape (not shown) moving in the direction of an arrow and stopping at each punching stage. The lower assembly 5 comprises a lower base 6 fixed on a stationary plane, a backing plate 7 provided on the lower base 6, and a die plate 8 provided on the backing plate 7 and having punch slots (not shown) corresponding to the punches 9A.

Figure 2:
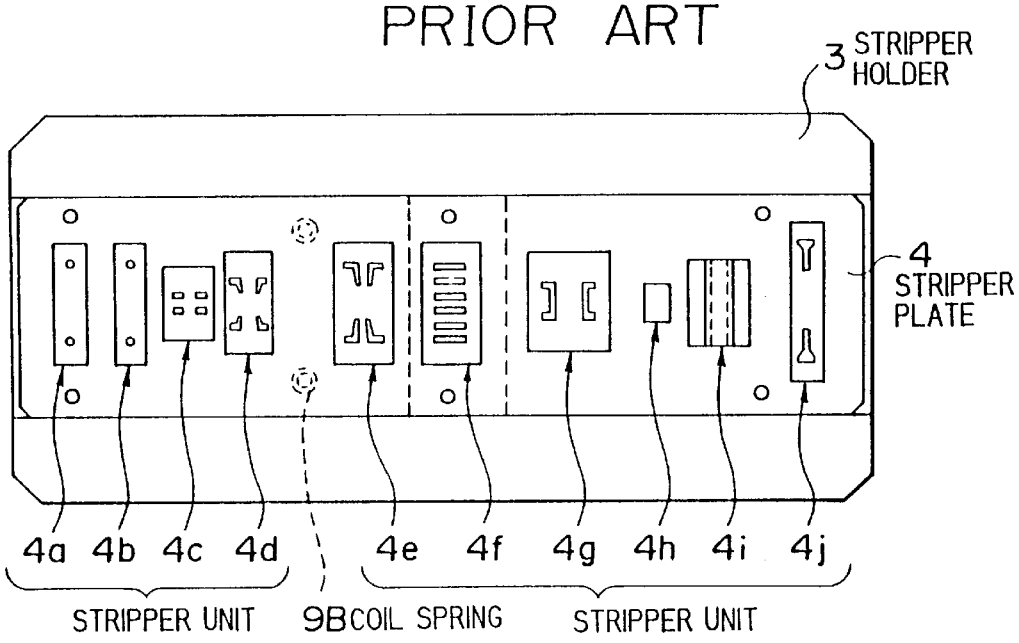
FIG. 2 PRIOR ART
FIG. 2 is a plan view showing a stripper plate held by a stripper holder in the conventional apparatus in FIG. 1.

FIG. 2 shows the stripper plate 4 fixed to the stripper holder 3 and having stripper units 4*a*, 4*b*, - - - 4*j*, (only 4*f* shown in FIG. 1) providing ten punching stages, wherein the stripper units 4*a*, 4*b*, - - - 4*j* are perforated with punch slots through which the punches 9A protrude, as illustrated therein by different patterns.

Figure 3:
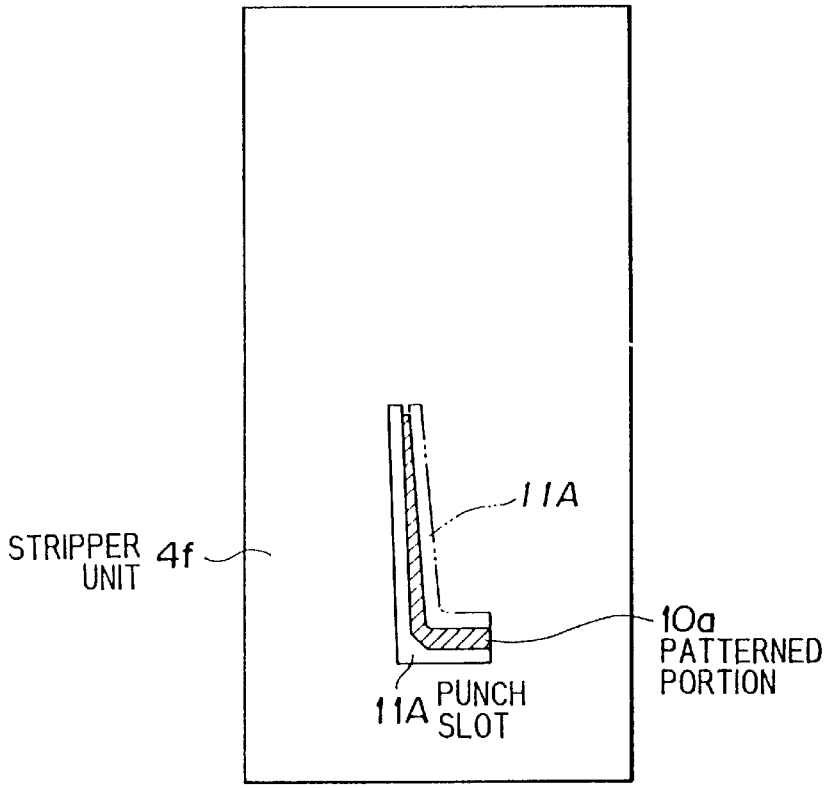
FIG. 3 PRIOR ART
FIG. 3 is a plan view showing a stripper unit for the stripper plate in FIG. 2.

FIG. 3 shows the stripper unit 4*f* having punch slots 11A (pattern illustrated not to correspond to that in FIG. 2) under which a patterned portion 10*a* of the metal tape is positioned.

Figure 4:
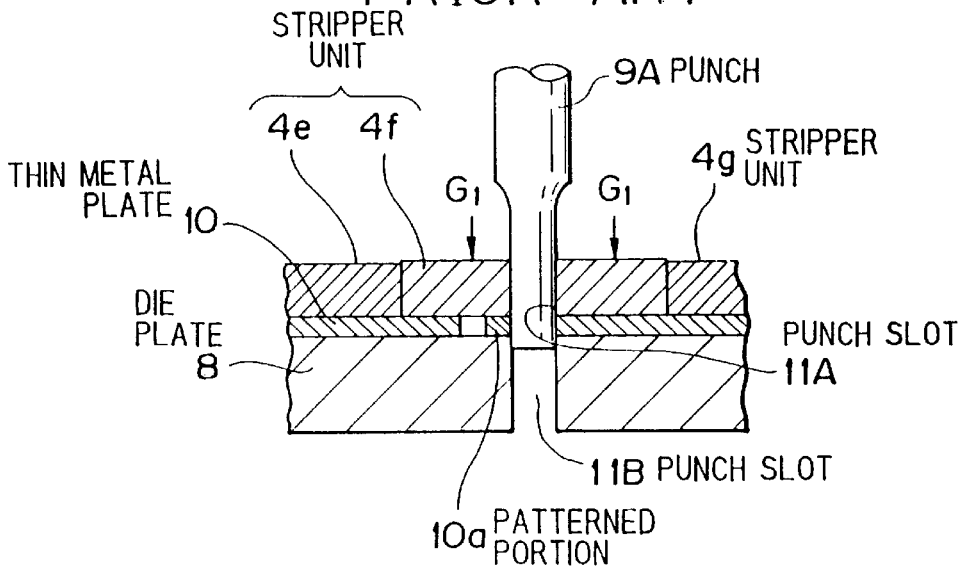
FIG. 4 PRIOR ART
FIG. 4 is a partial cross-sectional view showing punching operation in the conventional apparatus in FIG. 1, FIGS. 5A and 5B are a plan view and a cross-sectional view showing one type of a punch slot in the stripper unit for the stripper plate in FIG. 2, FIGS. 6A and 6B are a plan view and a cross-sectional view showing another type of a punch slot for the stripper plate in FIG. 2.

FIG. 4 shows one punching stage where a thin metal plate 10 is placed on the die plate 8 having a punch slot 11B to be under the stripper plate 4 (units 4*e*, 4*f* and 4*g*) having the punch slot 11A, and the punch 9A is inside the punch slots 11A and 11B.

Figure 5A:
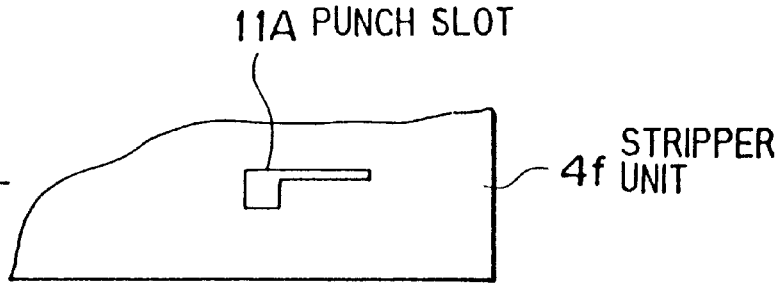
FIG. 5A PRIOR ART
Figure 5B:
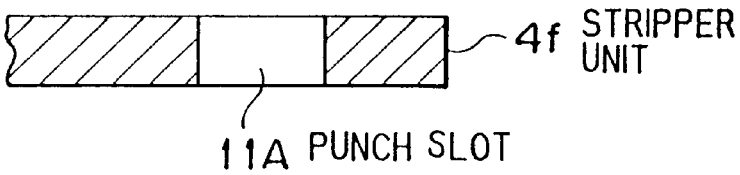
FIG. 5B PRIOR ART
Figure 6A:
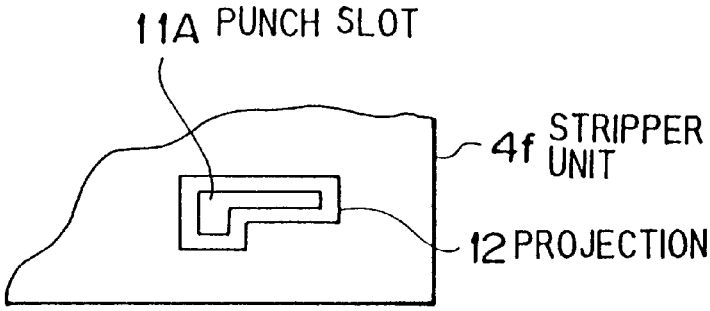
FIG. 6A PRIOR ART
Figure 6B:
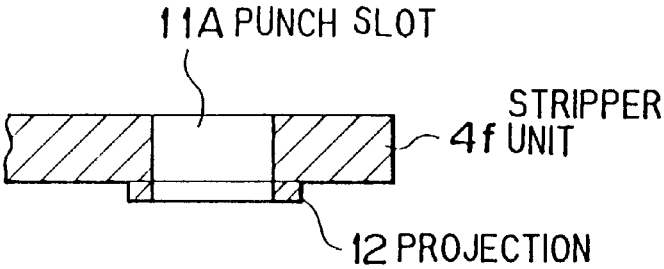
FIG. 6B PRIOR ART

FIGS. 5A and 5B show one type of the stripper unit 4*f* being flat on the both surfaces and having the punch slots 11A, while FIG. 6A and 6B show the other type of the stripper unit 4*f* having a projection 12 surrounding the punch slot 11A on a surface in contact with the metal tape 10.

In operation, the upper base 2 is moved down for the pushing rod 9C to push the stripper holder 3 down, and the punch 9A moves down at the same time, so that the stripper plate 4 becomes contacted with the metal tape 10 placed on the die plate 8, and the stripper holder 3 and the stripper plate 4 are stopped to press the metal tape 10 in accordance with a pressing force generated by the coil spring 9B, while the upper base 2 continues moving down by a limited distance, and the punch 9A protrudes through the punch slot 11A of the stripper plate 4 from the stripper holder 3 to be inserted into the punch slot 11B of the die plate 8. Consequently, the metal tape 10 is punched with a predetermined pattern (only one portion 10*a* shown) by applying the punch operation at each punching stage to the metal tape 10.

Figure 7:
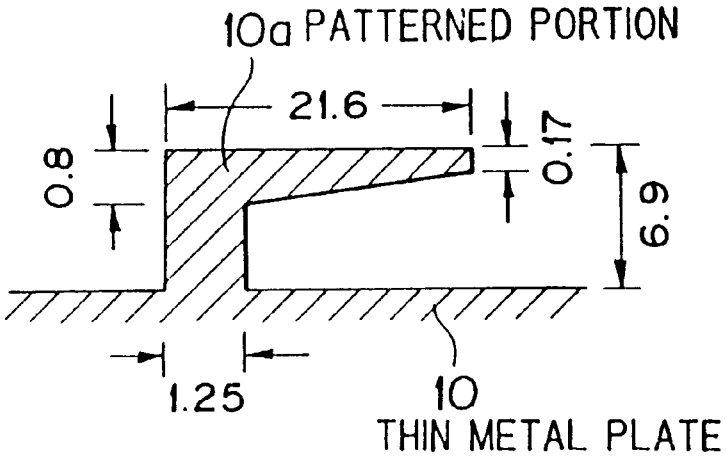
FIG. 7 PRIOR ART
FIG. 7 is an explanatory view showing the dimension of a lead frame as a punched pattern.

The patterned portion 10*a* of the metal tape 10 as punched to provide a lead frame is shown in FIG. 7, wherein each dimension is indicated by the unit of "mm".

In the conventional punching apparatus, the pressing force as indicated in FIG. 4 by the reference symbol $G_1$ is 1.0 kg/mm$^2$ at most, and 0.1 kg/mm$^2$ under the ordinary punching condition. Although discussed later, the stripper holder 3 is made of tool steel such as "SKD-11(JIS)" and is of a thickness ranging 40 mm to 50 mm as indicated in FIG. 1 by the reference symbol h.

Figure 8:
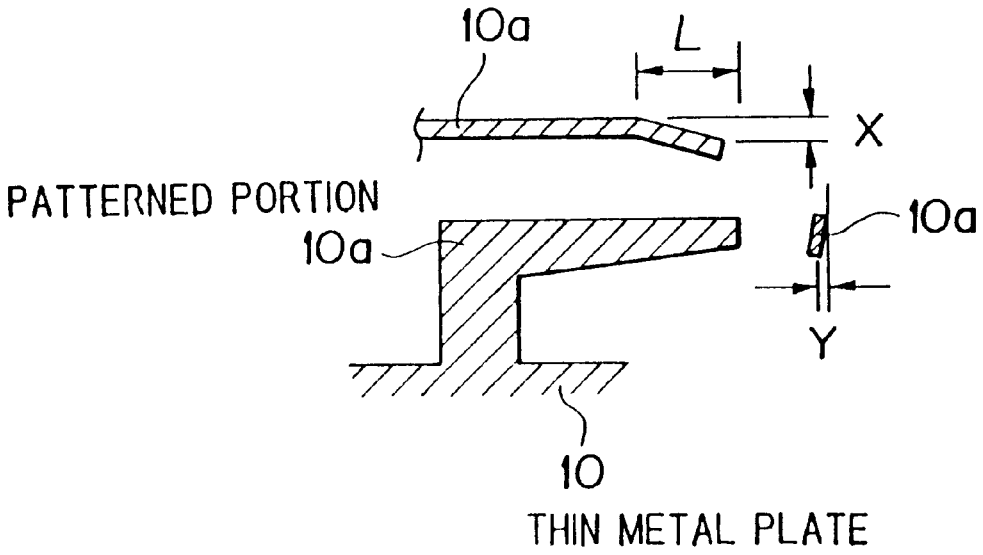
FIG. 8 PRIOR ART
FIG. 8 is an explanatory view showing deflection and torsion of the lead frame in FIG. 7.

In the conventional punching apparatus, however, the deflection and the torsion of the patterned portion 10*a* of the metal tape 10 can not be avoided as shown in FIG. 8, even if any type of the stripper unit as shown in FIGS. 5A and 5B or 6A and 6B is adopted. In FIG. 8, a tip portion of the patterned portion 10*a* having a length L is deflected by an amount X and torsioned by an amount Y.

Figure 9:
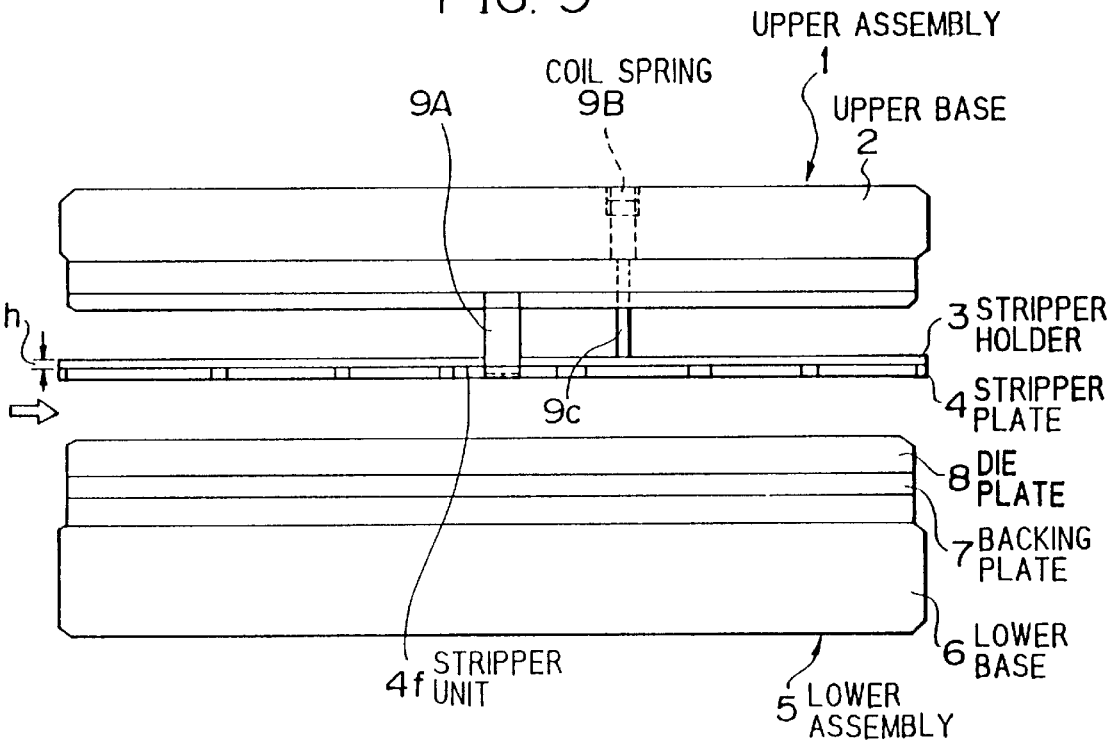
FIG. 9 is a front view showing an apparatus for punching a metal plate to be a patterned member in a first preferred embodiment according to the invention.
Figure 10:
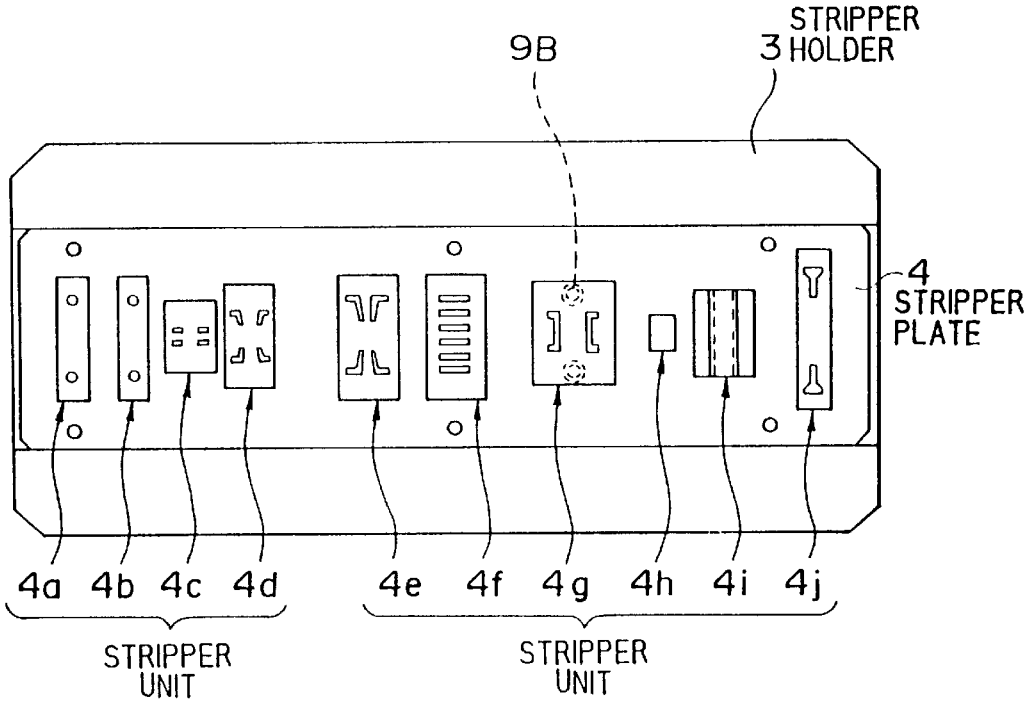
FIG. 10 is a plan view showing a stripper plate held by a stripper holder in the punching apparatus in FIG. 9.

Next, an apparatus for punching a metal tape to be a patterned member in the first preferred embodiment according to the invention will be explained in FIGS. 9 and 10, wherein like parts are indicated by like reference numerals and symbols as used in FIGS. 1 and 2.

The first feature in the first preferred embodiment is that the coil springs 9B are designed in total to generate a pressing force G ($>G_1$) which is greater than an elastic limit of a metal tape 10 such as 42 alloy. and less than a yield point thereof, preferably, 110% of the elastic limit.

Figure 11:
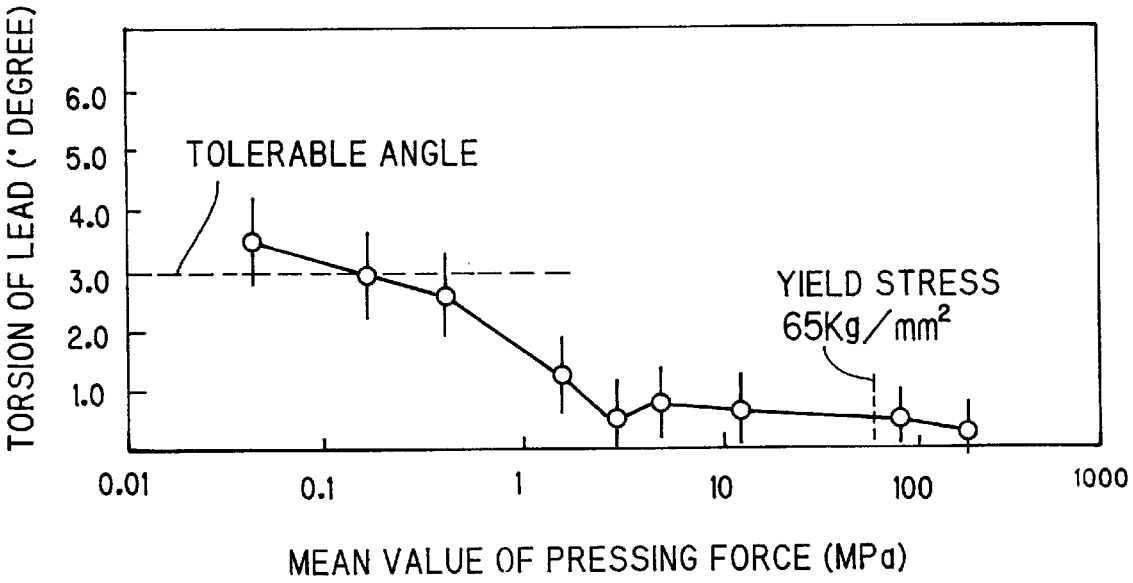
FIG. 11 is a graph explaining the relation between a torsion angle of a lead and a pressing force applied to a metal tape in the preferred embodiment.

In this connection, FIG. 11 shows the relation between a torsion angle (Y-axis) of a lead and a pressing force G (X-axis) applied to a metal tape 10, wherein the lead is made of 42 alloy, and is 12 mm in length, 0.2 mm in width, and 0.15 mm in thickness, and the torsion angle is measured relative to 0° indicative of no torsion, while the pressing force G is a mean value obtained by dividing a total force generated to be applied to the metal tape 10 by all the coil springs 9B by an area of the metal tape 10.

As understood from the graph in FIG. 11, the pressing force G is required to be greater than 3 kg/mm$^2$, so that the standard is met by suppressing the torsion angle to be less than 3° (three degrees). However, some users require the torsion angle to be less than 1° (one degree). For this purpose, the pressing force G becomes approximately the yield point (65 kg/mm$^2$) which is slightly greater than an elastic limit of 42 alloy.

The second feature in the first preferred embodiment is that the thickness h of the stripper holder 3 is reduced to be one thirds to half (⅓ to ½) of that in the conventional punching apparatus. Thus, the thickness-reduced stripper holder 3 is flexible to conform with the deformation of the die plate 8. If it is assumed that the thickness h of the stripper holder 3 is designed to be half that in the conventional punching apparatus, a bending force of the stripper holder 3 is reduced to be ⅛ (one eighths), so that the stripper plate 4 is easily forced to conform with the deformation of the die plate 8. In this case, if the coil springs 9B are arranged exactly over the center of each punching stage 4*a*, 4*b*, 4*c*, - - - 4*j*, the effect of the conformity is further enhanced.

The third feature in the first preferred embodiment is that the backing plate 7 is made of super-hard alloy to prevent from being deformed, so that the die plate 8 does not deform to avoid the occurrence of the non-conformity between the stripper plate 4 and the die plate 8.

In the first preferred embodiment, the first, second and third features may be adopted solely or jointly. At any rate, a significant effect is found, especially, in punching a metal tape to provide a lead frame having inner leads of a width narrower than a thickness of the metal tape.

Figure 12:
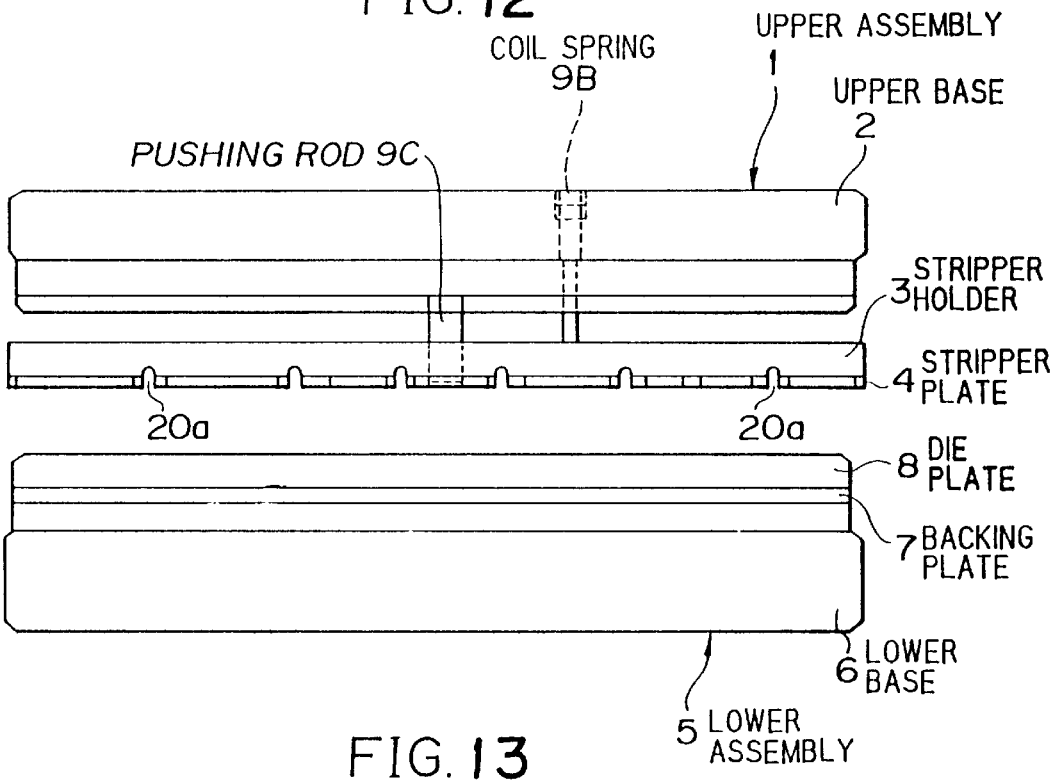
FIG. 12 is a front view showing an apparatus for punching a metal tape to be a patterned member in a second preferred embodiment according to the invention.
Figure 13:
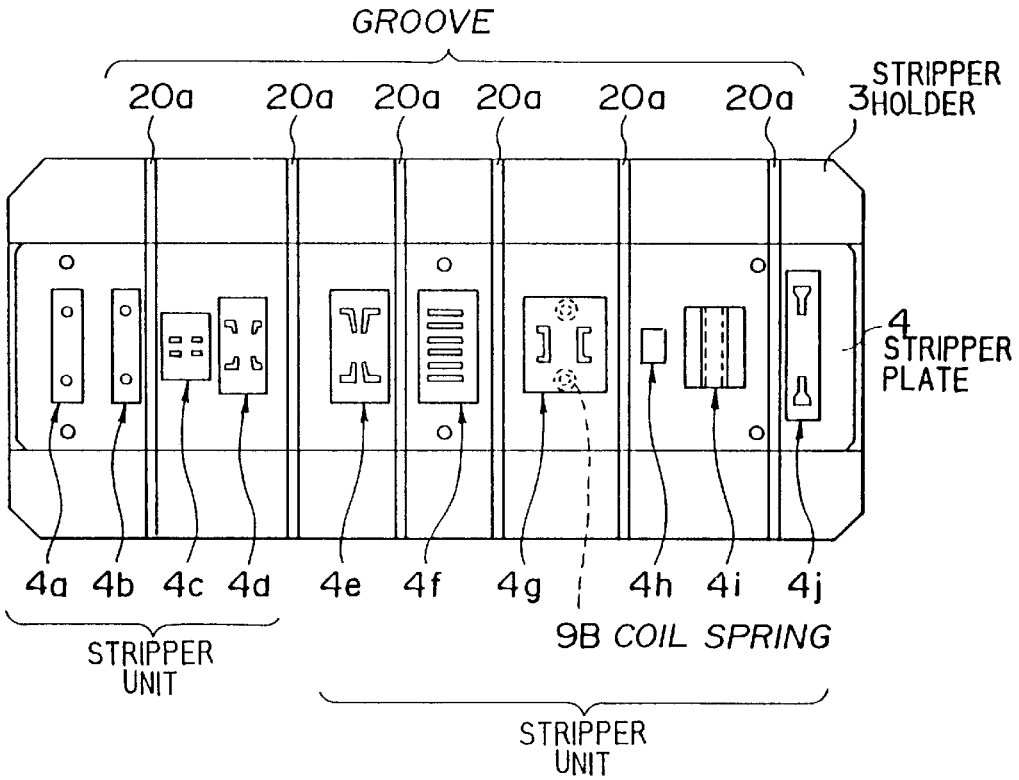
FIG. 13 is a plan view showing a stripper plate held by a stripper holder in the punching apparatus in FIG. 12, FIGS. 14 and 15 are a plan view and a cross-sectional view (X—X in FIG. 14) showing a stripper unit for a stripper plate in a punching apparatus in a third preferred embodiment.

FIGS. 12 and 13 show an apparatus for punching a metal tape to be a patterned member in the second preferred embodiment according to the invention, wherein like parts are indicated by like reference numerals and symbols as used in FIGS. 1 and 2, and 9 and 10.

The feature in the second preferred embodiment is that the stripper holder 3 is provided with grooves 20*a* at positions corresponding to boundaries of the stripper units 4*a*, 4*b*, 4*c* - - - 4*j*, so that a bending force of the stripper holder 3 is lowered to result in the same effect as in the second feature of the first preferred embodiment.

Figure 14:
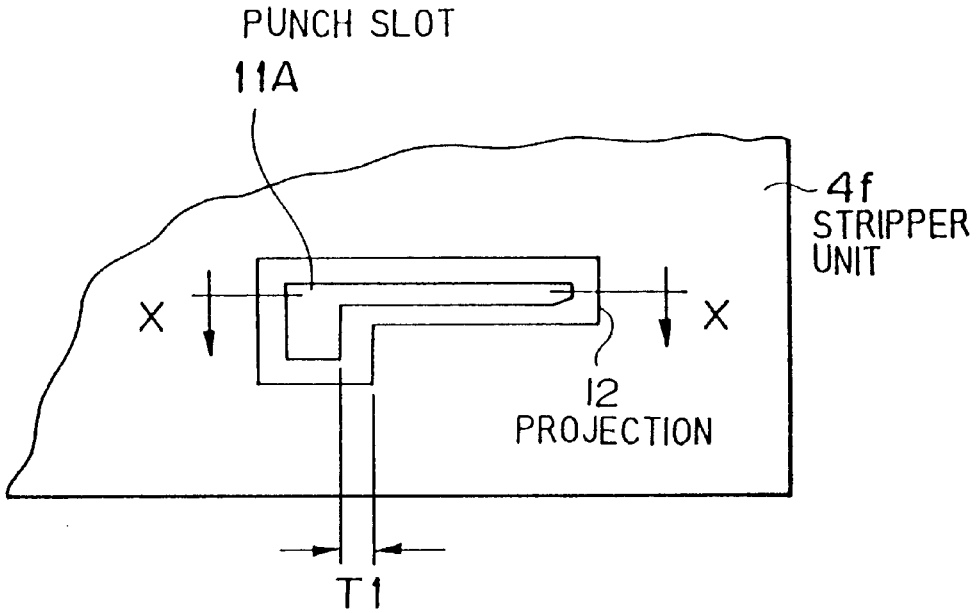
Figure 15:
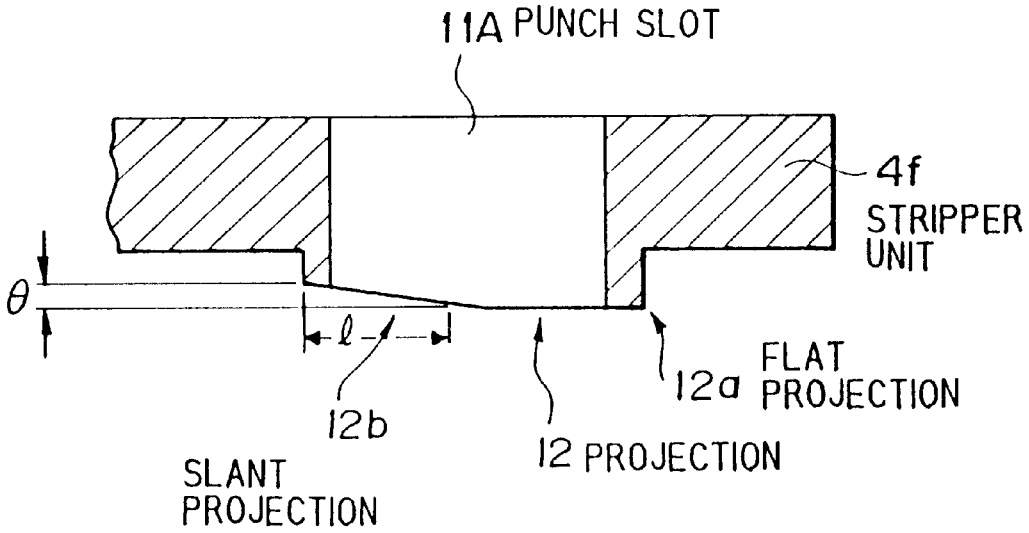

FIGS. 14 and 15 show a stripper unit, 4*f* used for an apparatus for punching a metal tape to be a patterned member in the third preferred embodiment according to the invention.

The stripper unit 4*f* is provided with a punch slot 11A and a projection 12 surrounding the punch slot 11A on a surface in contact with a metal tape 10 placed on the die plate 8. The other stripper units have the similar structure to that of the stripper unit 4*f*, in which he projection 12 comprises a flat projection 12*a* for a plying a large pressing force to the metal tape 10 an a slant projection 12*b* for applying a small pressing force thereto and releasing some force from a portion of the metal tape 10 pressed by the flat projection 12*a*. A width T1 of the projection 12 is 0.5 to 1.0 mm, and the slant amount θ between the flat and slant projections 12*a* and 12*b* is approximately 10 mm.

Figure 16:
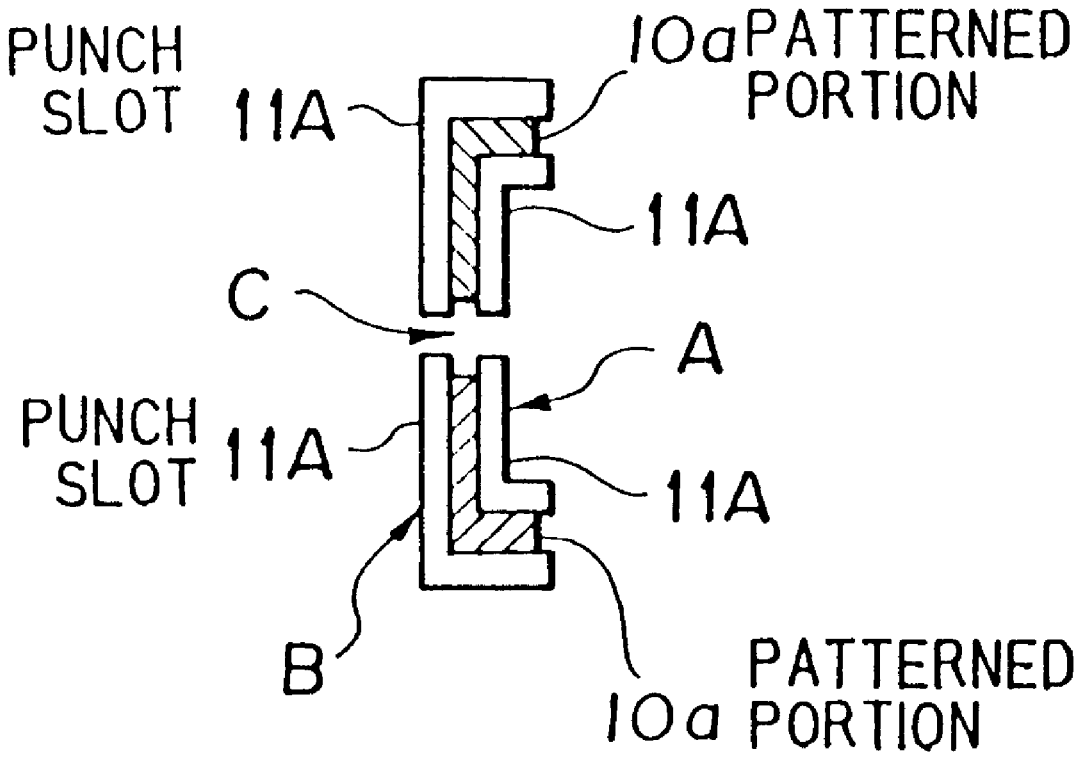
FIG. 16 is an explanatory view showing the order of sequentially pressed positions in punching operation carried out by the stripper unit in FIGS. 14 and 15.

FIG. 16 shows sequential punching portions A, B and C, wherein the patterned portion 10*a* is obtained by firstly punching the portion A of the metal tape 10, secondly the portion B thereof, and thirdly the portion C thereof.

The patterned portion 10*a* is punched by using the stripper plates 4 as shown in FIGS. 5A and 5B, 6A and 6B, and 14 and 15, respectively, in accordance with the sequential punching stages as shown in FIG. 16. In using the stripper unit 4*f* as shown in FIGS. 14 and 15, a length l of the slant projection 12*b* is 8.0 mm. In punching the patterned portion 10*a*, the deflection X and the torsion Y as shown in FIG. 8 is observed to indicate in the table 1.

TABLE 1

| STRIPPER PLATE | PRESSING FORCE | DEFLECTION (X) | TORSION (Y) |
|---|---|---|---|
| FIGS. 5A AND 5B | 100 kg | 0.04 mm | 8° IN CLOCK-WISE DIRECTION |
| FIGS. 6A AND 6B | 100 kg | 0.04 mm | 3° IN COUNTER CLOCKWISE DIRECTION |
| FIGS. 14 AND 15 | 100 kg | 0.005 mm | 0° 20' IN COUNTER CLOCK-WISE DIRECTION |

As apparent from the: table 1, the deflection and torsion amounts of the patterned portion 10*a* are decreased in the invention as compared to that in the conventional punching apparatus by one tenths, because the portion L of the patterned portion 10*a* (FIG. 8) is effectively pressed by the flat projection 12*a*, while the pressing force is advantageously released therefrom to the slant projection 12*b*.

In the third preferred embodiment, a total pressing force can be decreased, and a punching force. can be also decreased, because the pressing operation of the stripper plate 4 is effectively carried out.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A method for punching a thin metal tape to provide a lead frame for a semiconductor device, the method comprising the steps of:

placing said thin metal tape on a die plate;

pressing said thin metal tape placed on said die plate around a periphery of a portion to be punched by a pressing force which is greater than an elastic limit of said thin metal tape and less than a breakage force thereof;

said pressing force being 110% of said elastic limit at most; and punching said thin metal tape pressed on said die plate to provide said lead frame.

2. A method for punching a thin metal tape to provide a patterned lead frame with reduced distortion for a semiconductor device, comprising the steps of:

(a) placing said thin metal tape on a die plate;

(b) pressing said thin metal tape placed on said die plate around a periphery of a portion to be punched by a pressing force which is greater than an elastic limit of said thin metal tape and less than a breakage force thereof;

(c) punching an opening through said thin metal tape pressed on said die plate to provide said patterned lead frame, said punching being within said periphery of said portion to be punched, said portion within said periphery being unpressed in step b.

* * * * *